US005263818A

United States Patent [19]

Ito et al.

[11] Patent Number: 5,263,818

[45] Date of Patent: Nov. 23, 1993

[54] PUMP FOR PUMPING FLUID WITHOUT VACUUM BOILING

[75] Inventors: Motoya Ito, Anjo; Minoru Yasuda, Chiryu, both of Japan

[73] Assignee: Nippondenso Co., Ltd., Kariya, Japan

[21] Appl. No.: 970,384

[22] Filed: Nov. 2, 1992

[30] Foreign Application Priority Data

Nov. 5, 1991 [JP] Japan ..... 3-288637

[51] Int. Cl.[5] ..... F04C 2/10; F04C 15/02

[52] U.S. Cl. ..... 418/15; 418/171

[58] Field of Search ..... 418/15, 171

[56] References Cited

U.S. PATENT DOCUMENTS

| | | | |
|---|---|---|---|
| 2,948,229 | 8/1960 | Brundage | 418/171 X |
| 3,237,566 | 3/1966 | Roenick | 418/171 |
| 3,242,867 | 3/1966 | Mosbacher | 418/15 |
| 3,834,842 | 9/1974 | Dorff et al. | 418/171 X |
| 4,493,620 | 1/1985 | Takei et al. . | |
| 4,540,354 | 9/1985 | Tuckey . | |
| 4,596,519 | 6/1986 | Tuckey . | |
| 4,697,995 | 10/1987 | Tuckey | 418/171 X |

FOREIGN PATENT DOCUMENTS

| | | | |
|---|---|---|---|
| 64297 | 11/1955 | France | 418/171 |
| 3-74565 | 3/1991 | Japan . | |
| 4-54271 | 2/1992 | Japan . | |

*Primary Examiner*—Richard E. Gluck

*Attorney, Agent, or Firm*—Cushman, Darby & Cushman

[57] ABSTRACT

A pump comprises an outer rotor and an inner rotor. A plurality of pressure chambers are defined between the outer rotor and the inner rotor to cause fluid to be sucked from a suction port and discharged to a discharge port by the movement of these pressure chambers with changing their volumes. A pressure relief passage is opened between the discharge port and the suction port and communicated directly with a fuel tank provided outside the pump. This causes the pressure in the pressure chamber to be reduced before the pressure chamber is communicated with the suction port. In consequence, it is possible to prevent the fuel of discharge pressure in the pressure chamber from being brought in the suction port, thereby preventing the generation of vapor caused due to vacuum boiling and the reduction of discharge rate.

12 Claims, 6 Drawing Sheets

PUMP FOR PUMPING FLUID WITHOUT VACUUM BOILING

FIELD OF THE INVENTION AND RELATED ART STATEMENT

The present invention relates to a pump for pressurizing fluid, which is applicable to a vehicle fuel pump, for example.

Heretofore, gear pumps of trochoid type and the like have been known widely. Further, it has been proposed to use such displacement rotary pumps as vehicle fuel pumps, as disclosed in U.S. Pat. Nos. 4,540,354 and 4,596,519, for example.

In this type of gear pump, a plurality of pressure chambers are formed between an outer rotor formed with internal gear teeth and an inner rotor which is eccentrically received inside the outer rotor and formed with external gear teeth meshing with the internal gear teeth. The outer and inner rotors are rotated to move the pressure chambers while changing the volume of each pressure chamber, thereby causing the fluid to be sucked and discharged In the gear pump described above, it is desirable that the volume of each pressure chamber becomes 0 (zero) at a trailing end of a discharge port and begins to increase at a leading end of a suction port. Actually, however, the volume of the pressure chamber does not become 0 (zero) at the trailing end of the discharge port. As a result, after finishing the discharge stroke in the discharge port, fluid at a discharge pressure remains in the pressure chamber. Therefore, the fluid at a discharge pressure is even brought into the suction port.

In case that the above-described gear pump is used for pumping fluid of a relatively low boiling point, the fluid is brought from the discharge port into the suction port, resulting in vacuum boiling which arises a problem that vapor is generated in the suction port.

Further, particularly in case that the gear pump is used for pumping fuel such as gasoline, a large amount of vapor is generated particularly at high temperatures, thereby giving rise to problems including the reduction of the discharge rate and the production of noise.

OBJECT AND SUMMARY OF THE INVENTION

An object of the present invention is to suppress the generation of vapor in a suction port of a pump in order to solve the above-described problems.

To this end, according to the present invention, each pressure chamber from which fluid is discharged to a discharged port is passed over a partition portion and, due to the provision of a pressure relief passage, it is communicated with the outside of a pump before it is communicated with a suction port. Therefore, since the fluid pressure in the pressure chamber is reduced before the pressure chamber is communicated with the suction port, it is possible to prevent vapor from being generated due to vacuum boiling which will take place when the fluid of discharge pressure is brought in the suction port.

DETAILED DESCRIPTION OF PREFERRED EMBODIMENTS

Description will be given below of a vehicle fuel pump according to a first embodiment of the present invention with reference to FIGS. 1 to 3. The vehicle fuel pump of this embodiment, to which a fuel filter, not shown, attached is to be mounted in a fuel tank.

Figure 1:
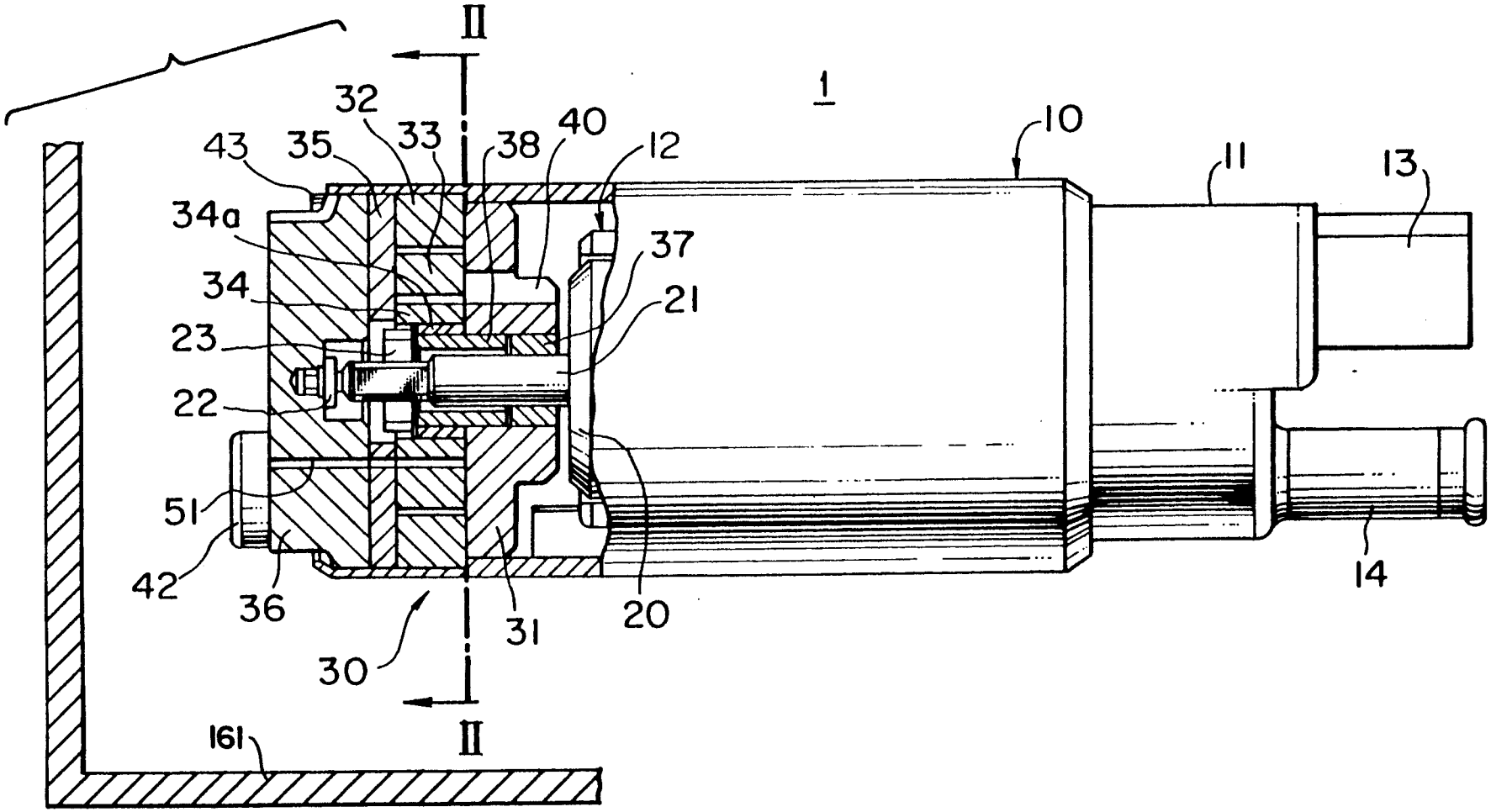
FIG. 1 is a fragmentary sectional view of a vehicle fuel pump according to a first embodiment of the present invention.
Figure 2:
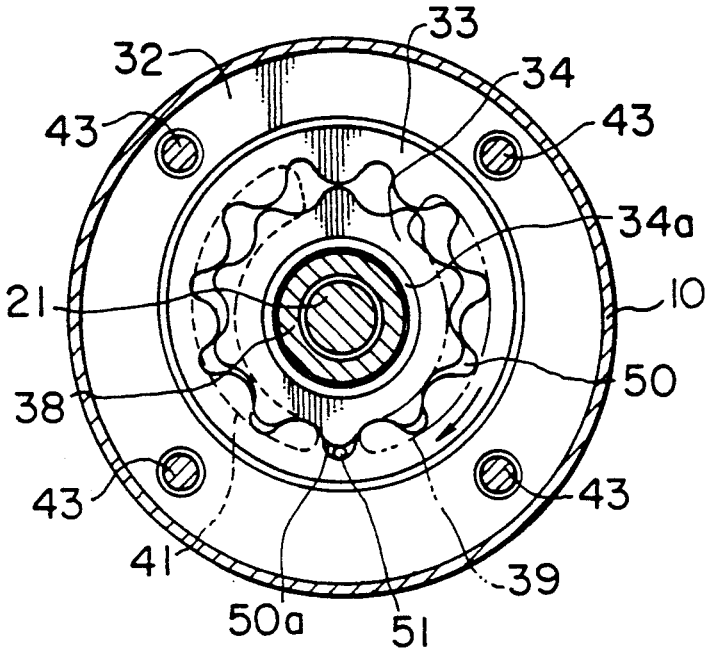
FIG. 2 is a sectional view taken along the line II—II of FIG. 1.

In FIGS. 1 and 2, a fuel pump 1 includes a cylindrical housing 10, which is provided at one end thereof with a cover 11. The cover 11 is provided with a power supply connector 13 and an outlet port 14 through which pressurized fuel is to be discharged. A motor unit 12 which serves as driving means is disposed in a central part of the housing 10.

At the other end of the housing 10 is provided a pump unit 30. The pump unit 30 comprises a pump casing 31, a spacer 32, an outer rotor 33, an inner rotor 34, a spacer cover 35 and a pump cover 36.

The pump casing 31 is press-fitted in the inner periphery of the housing 10. The pump casing 31 is formed in a center thereof with a hole in which a bearing 37 and a cylindrical bush 38 are press-fitted to bear a shaft 21 of an armature 20 of the motor unit 12. Further, the pump casing 31 is formed with an exhaust port 39 to extend a prescribed range, which is illustrated by the imaginary line (two-dot chain line) in FIG. 2. The exhaust port 39 communicates with an interior of the housing 10 through an exhaust passage 40.

The tubular spacer 32 is inserted in the inner periphery of the housing 10 and prevented from turning. The spacer 32 is formed in the inner portion thereof with a cylindrical opening whose center is offset by a predetermined distance.

The tubular outer rotor 33 is received in the cylindrical opening of the spacer 32. The outer rotor 33 is formed in an inner periphery thereof with trochoid teeth.

The inner rotor 34 is received within the outer rotor 33. The inner rotor 34 is provided at an outer periphery thereof with trochoid teeth, the number of which is smaller by one than that of the outer rotor 33. The inner rotor 34 is formed in the inner portion thereof with an opening to which a bearing 34*a* is press-fitted. The inner rotor 34 is rotatably supported by the bush 38 through the bearing 34*a*.

The spacer cover 35 is inserted in the inner periphery of the housing 10 and prevented from turning so as to restrain the outer and inner rotors 33 and 34 from axially moving. The spacer cover 35 is formed with a suction port 41 to extend a predetermined range, which is illustrated by the hidden line (broken line in FIG. 2.

The pump casing 31 is formed with four female tapped holes (not shown) which are engaged with screws 43, while the spacer 32 is formed with openings for the screws 43. The pump casing 31, the spacer 32 and the spacer cover 35 are tightened together with the screws 43 to form a casing member, generally indicated at 160. The axial thicknesses of the outer and inner rotors 33 and 34 are so selected as to be smaller than that of the spacer 32 by about 10 μm–30 μm so that they are received rotatably.

Further, the pump cover 36 is inserted in the inner periphery of the housing 10 and fixed by means of caulking. The pump cover 36 is formed with an inlet port 42 which is in turn communicated with the suction port 41 formed in the spacer cover 35.

The shaft 21 of the motor unit 12 is rotatably supported by the bearing 37 and axially held by a pin 22. The shaft 21 is formed in the end portion thereof with parallel planes on which a coupling 23 is provided. The coupling 23 is brought into engagement with the inner rotor 34 to transmit the rotation of the shaft 21 to the inner rotor 34.

The outer and inner rotors 33 and 34 are assembled with a predetermined eccentricity as shown in FIG. 2 so as to provide a plurality of pressure chambers 50 between the trochoid teeth of the outer rotor 33 and of the inner rotor 34. The chambers 50 are closed by the pump casing 31 and the spacer cover 35.

Further, a pressure relief passage 51 is provided to communicate the pressure chamber located in a position indicated by 50*a* shown in FIG. 2 with the outside of the pump cover 36. The pressure relief passage 51 is composed of a hole formed in the spacer cover 35 and a hole formed in the pump cover 36. The pressure relief passage 51 is opened at the pressure chamber side of the spacer cover 35 just in front of the suction port 41 with respect to the rotating direction of the pump so that it is to be communicated with the smallest pressure chamber located in the position indicated by 50*a* as shown in FIG. 2. On the other hand, the pressure relief passage 51 is opened at the outside of the pump cover 36 so as to be directly opened into the fuel tank 161.

Next, operation of the above-described embodiment will be described hereinafter.

In practical use of the fuel pump 1 shown in FIG. 1, a fuel filter which is not shown is attached to the inlet port 42, a pipe leading to an unillustrated fuel injection device of a vehicle engine is connected to the outlet port 14, a connector which is to be connected to an unillustrated battery mounted on the vehicle is connected to the connector 13, and the fuel pump 1 is to be held in the fuel tank which is not shown.

When the power is supplied through the connector 13, the shaft 21 of the motor unit 12 rotates. The shaft 21 rotates clockwise in FIG. 2. The inner rotor 34 is rotated by the shaft 21 through the coupling 23 and, further, the outer rotor 33, which is engaged with the inner rotor 34, is also rotated. Therefore, the pressure chambers 50 defined between the outer and inner rotors 33 and 34 are moved clockwise in order. At this time, furthermore, since the both rotors are positioned off center from each other, the volume of each pressure chamber 50 is increased gradually on the left side of FIG. 2 while decreased gradually on the right side thereof. Therefore, the fuel is sucked from the suction port 41 and discharged to the exhaust port 39. In consequence, the fuel in the fuel tank can be taken in through the inlet port 42, pressurized in the pump unit, and discharged from the outlet port 14 through the inside of the housing 10.

In the circular movement of each pressure chamber 50, on arriving at the position between the exhaust port 39 and the suction port 41, the pressure chamber 50 is communicated with the pressure relief passage 51. It is noted here that the pressure chamber 50 having passed through the exhaust port 39 contains somewhat the fuel pressurized up to a discharge pressure. For this reason, there is a possibility that if the pressurized fuel flows into non-pressurized fuel in the suction port 41, vacuum boiling takes place to generate vapor, resulting in deterioration of the pump performance such as discharge rate and in production of noise. In the embodiment, however, since the pressure chamber 50 is to be communicated with the outside of the fuel pump 1 through the pressure relief passage 51 immediately before it is communicated with the suction port 41, the pressurized fuel can be discharged. In consequence, when the pressure chamber 50 is communicated with the suction port 41, the pressure in the pressure chamber 50 has been already reduced, and therefore, generation of vapor due to vacuum boiling of the fuel can be prevented, thereby making it possible to prevent deterioration of the pump performance such as discharge rate and production of noise.

Figure 3:
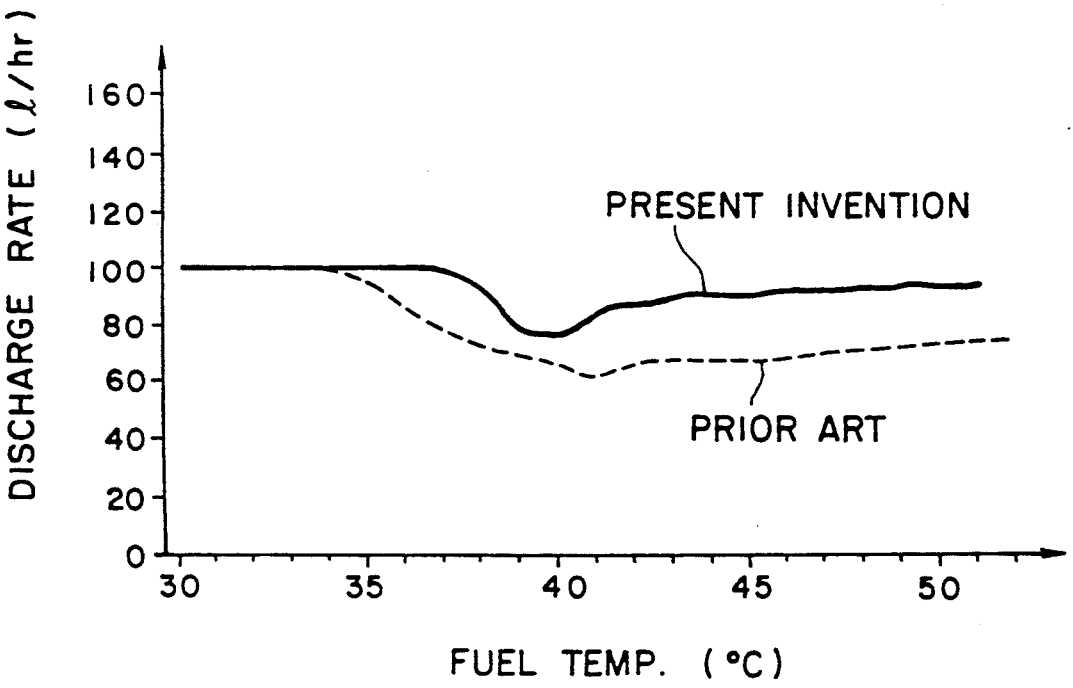
FIG. 3 is a graph showing change of the discharge rate of the first embodiment.

FIG. 3 is a graph showing the experimental results of this embodiment. The abscissa represents fuel temperature (°C.) and the ordinate represents discharge rate (l/hr). Change of the discharge rate obtained by this embodiment is indicated by the solid line, while change of the discharge rate obtained by a conventional pump which has no pressure relief passage is indicated by the broken line.

According to the conventional pump, at a higher fuel temperature where the vacuum boiling can be taken place easily, the discharge rate is reduced greatly. To the contrary, according to this embodiment, even if the fuel temperature is higher, it is possible to obtain a sufficient discharge rate.

It is important that the pressure relief passage is communicated with the outside of the pump. Namely, even if fuel discharged through the pressure relief passage generates vapor, it is required that such vapor can be prevented from being sucked into the inlet port 42. In addition, for the prevention of the noise produced by vapor generated from the pressure relief passage, a muffler chamber of an appropriate volume may be provided.

Figure 4:
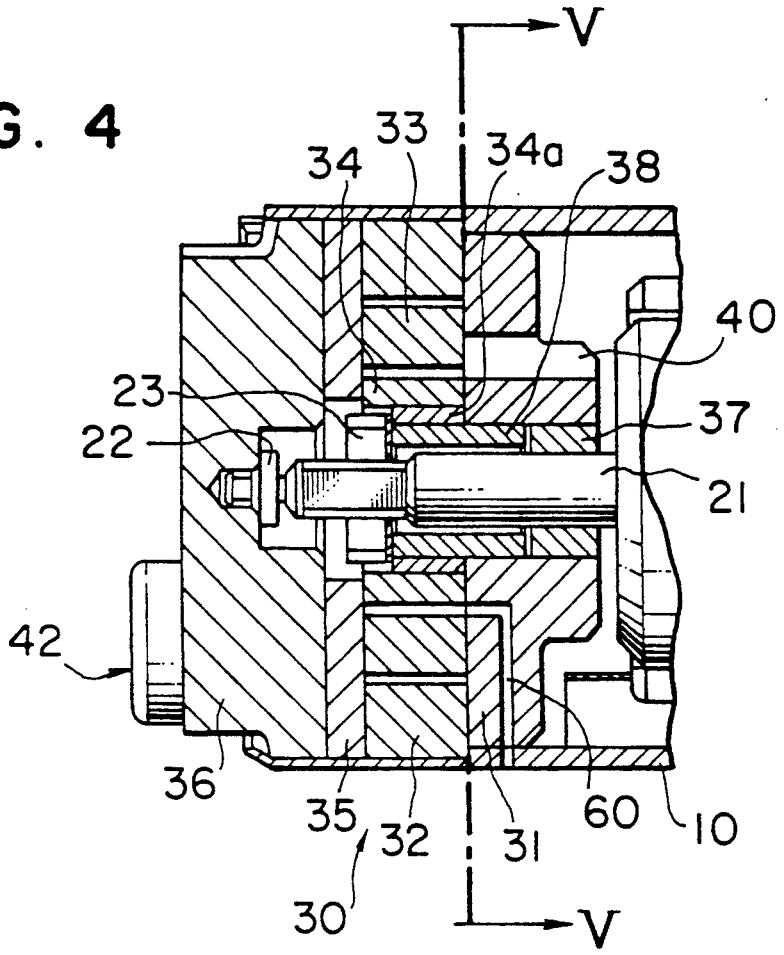
FIG. 4 is a fragmentary sectional view of a vehicle fuel pump according to a second embodiment of the present invention.
Figure 5:
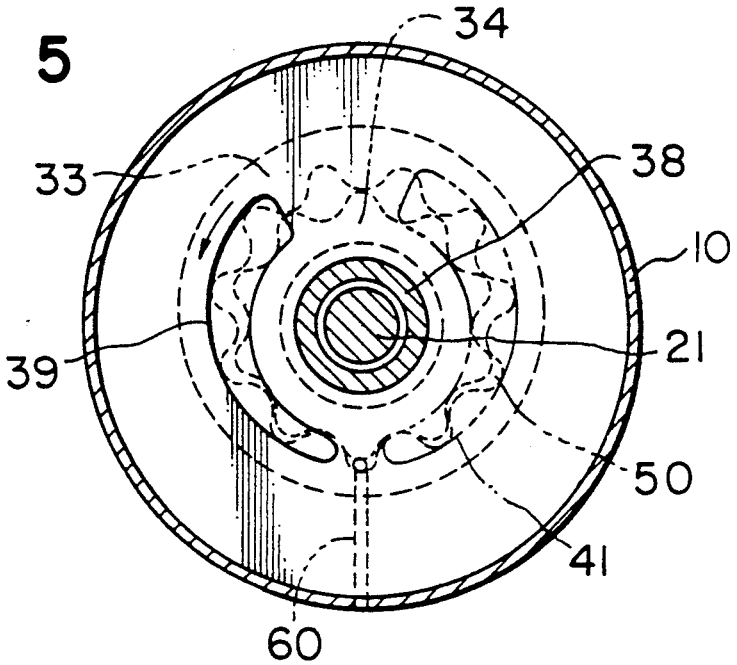
FIG. 5 is a sectional view taken along the line V—V of FIG. 4.

Next, a second embodiment of the present invention will be described hereinafter with reference to FIGS. 4 and 5.

In this embodiment, the structure of the vehicle fuel pump is substantially the same as that of FIG. 1 except the structure of the pressure relief passage. The description will be given against the structure of a pressure relief passage 60 solely, and then the same components as those of the first embodiment are designated by the same reference numerals and description thereof will be omitted. In FIG. 5, the screws are omitted and, in order to make it easy to understand the position of the opening of the pressure relief passage, the outer and inner rotors 33 and 34 are shown by the broken line and the suction port 41 is shown by the two-dot chain line.

In this embodiment, the pressure relief passage 60 extends through the pump casing 31 and the housing 10. The pressure relief passage 60 is composed of an axial hole and a radial hole communicated with the axial hole, which are formed in the pump casing 31, and of a hole which is communicated with the radial hole and penetrates through the housing 10. Like the first embodiment, the pressure relief passage 60 is opened to the pressure chamber side just in front of the point where the pressure chamber is being communicated with the suction port 41. Therefore, since the pressure chamber 50 is to be communicated with the fuel tank immediately before it is brought into being communicated with the suction port 41, the fuel pressure in the pressure chamber 50 is reduced to the pressure in the fuel tank. In consequence, it is possible to prevent vapor from being generated in the suction port due to vacuum boiling.

Figure 6:
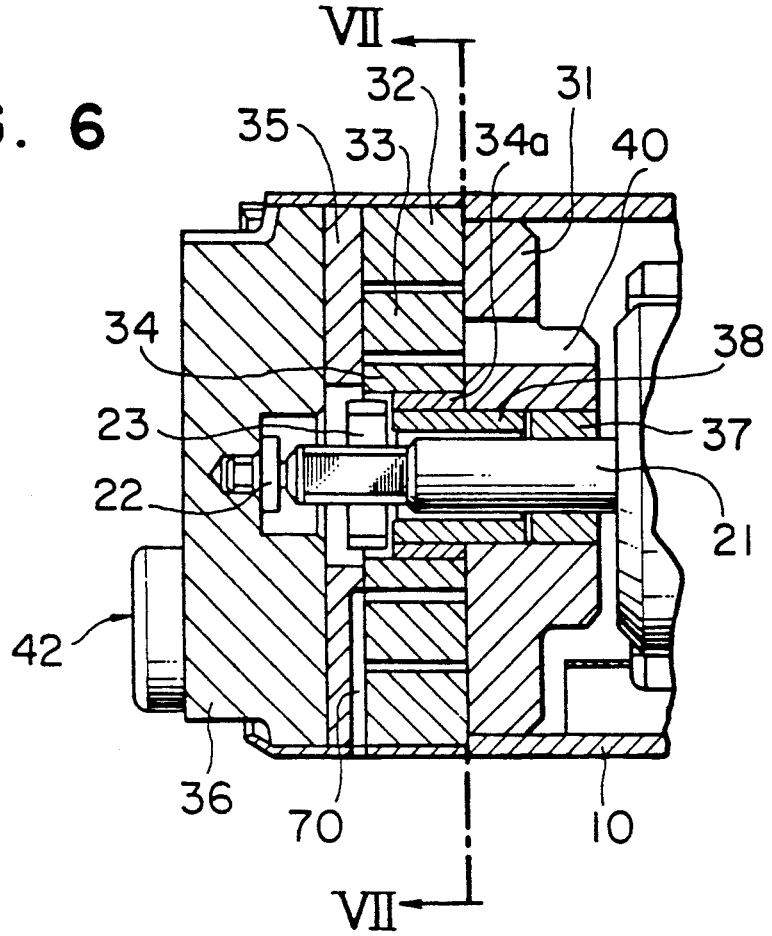
FIG. 6 is a fragmentary sectional view of a vehicle fuel pump according to a third embodiment of the present invention.
Figure 7:
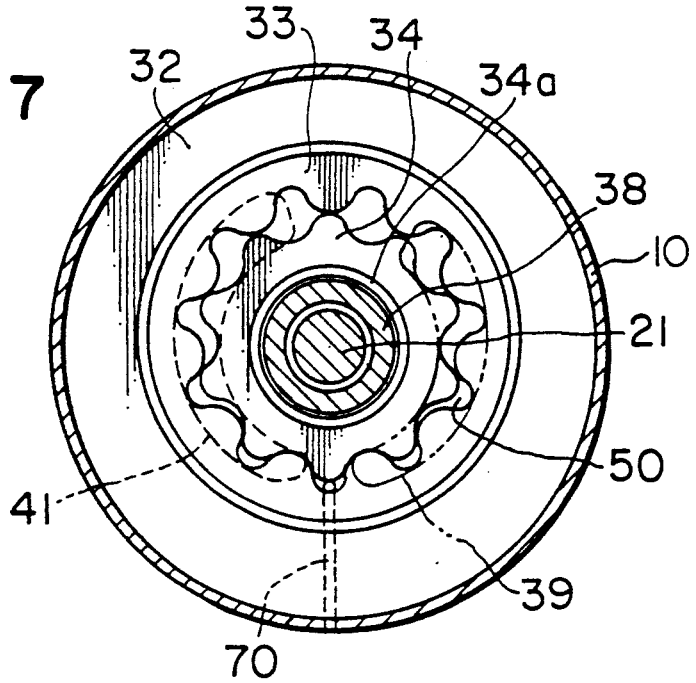
FIG. 7 is a sectional view taken along the line VII—VII of FIG. 6.

Next, a third embodiment of the present invention will be described hereinafter with reference to FIGS. 6 and 7.

In this embodiment, the structure of the vehicle fuel pump is substantially the same as that of FIG. 1 except the structure of the pressure relief passage alone. Description will be given below of the structure of a pressure relief passage 70 of this embodiment in which the same components as those of the first embodiment are designated by the same reference numerals and description thereof will be omitted. In FIG. 7, the screws are omitted and the exhaust port 39 is shown by the two-dot chain line and the suction port 41 is shown by the broken line.

In this embodiment, the pressure relief passage 70 is composed of a groove formed in a surface of the spacer cover 35 facing the rotors and a hole formed in the housing 10. A radial inner end of the groove formed in the spacer cover 35 extends just in front of the point where the pressure chamber is communicated with the suction port 41 so that the pressure relief passage 70 is to be communicated with the pressure chamber whose volume is minimum, as shown in FIG. 7. Therefore, since the pressure chamber 50 is to be communicated with the fuel tank through the pressure relief passage 70 immediately before it is brought into being communicated with the suction port 41, the fuel pressure in the pressure chamber 50 is reduced to the pressure in the fuel tank. In consequence, it is possible to prevent generation of vapor in the suction port 41 due to vacuum boiling.

Further, in this embodiment, since the pressure relief passage 70 includes the groove formed in the spacer cover 35, it can be formed more easily as compared with the case of the holes. In addition, the hole to be formed in the housing 10 can be made rather large beforehand, it is possible to provide the pressure relief passage easily without increasing the assembling accuracy beyond necessity.

Figure 8:
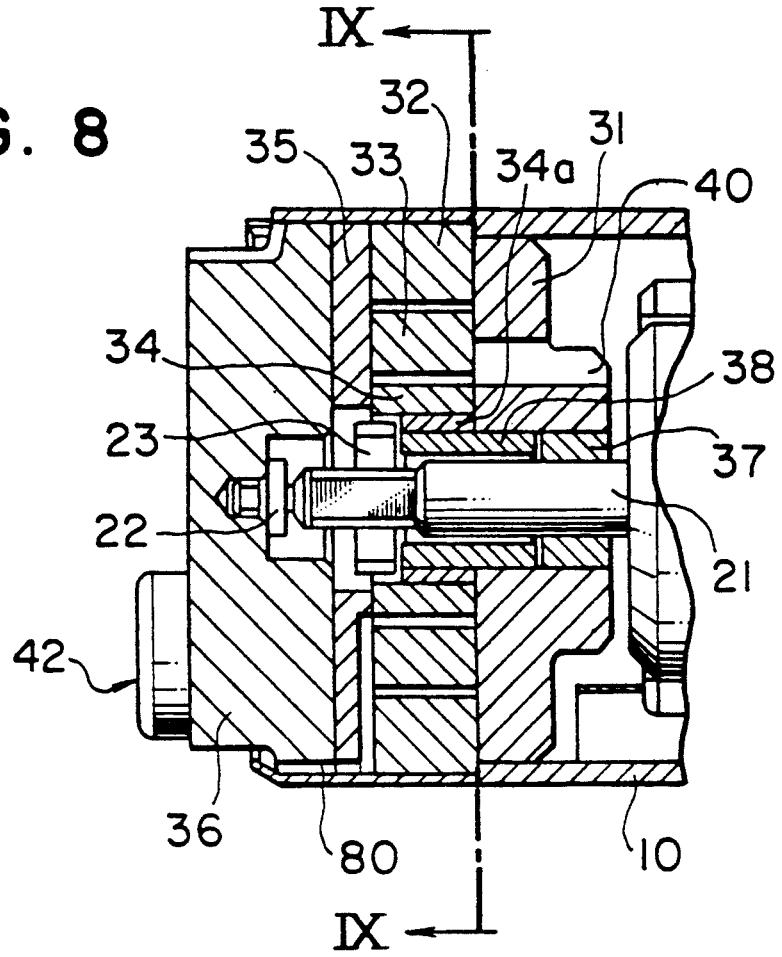
FIG. 8 is a fragmentary sectional view of a vehicle fuel pump according to a fourth embodiment of the present invention.
Figure 9:
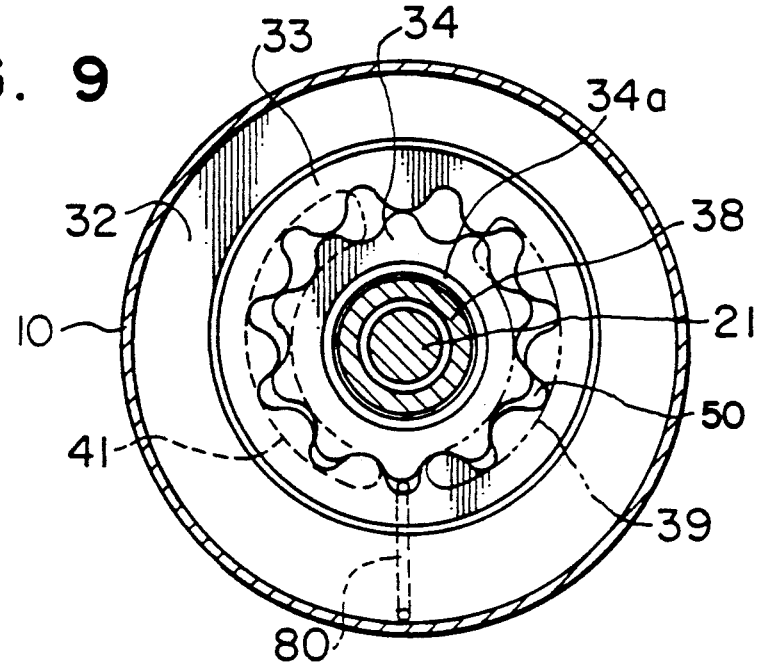
FIG. 9 is a sectional view taken along the line IX—IX of FIG. 8.

Next, a fourth embodiment of the present invention will be described hereinafter with reference to FIGS. 8 and 9.

In this embodiment, the structure of the vehicle fuel pump is substantially the same as that of FIG. 1 except the structure of the pressure relief passage alone. Description will be given below of the structure of a pressure relief passage 80 of this embodiment in which the same components as those of the first embodiment are designated by the same reference numerals and description thereof will be omitted. In FIG. 9, the screws are omitted and the exhaust port 39 is shown by the two-dot chain line and the suction port 41 is shown by the broken line.

In this embodiment, the pressure relief passage 80 is composed of a radial groove formed in a surface of the spacer cover 35 facing the rotors and axial grooves formed in outer peripheries of the spacer cover 35 and the pump cover 36. A radial inner end of the radical groove formed in the spacer cover 35 extends just in front of the point where the pressure chamber is communicated with the suction port 41 so that the pressure relief passage 80 is to be communicated with the pressure chamber whose volume is minimum, as shown in FIG. 9. Therefore, since the pressure chamber 50 is to be communicated with the fuel tank through the pressure relief passage 80 immediately before it is brought into being communicated with the suction port 41, the fuel pressure in the pressure chamber 50 is reduced to the pressure in the fuel tank. In consequence, it is possible to prevent generation of vapor in the suction port 41 due to vacuum boiling.

Further, in this embodiment, since the whole pressure relief passage 80 is constituted by the grooves, it can be formed more easily as compared with the case of the holes.

Next, a fifth embodiment of the present invention will be described hereinafter with reference to FIGS. 10 and 11. This embodiment is applied to a so-called "regenerative" type pump, in which fuel is caused to flow and pressurized by vane grooves formed in an impeller. The regenerative type pump is disclosed in U.S Pat. No. 4,493,620. Structure of the motor unit, discharge section and the like is the same as that of the first embodiment.

Figure 10:
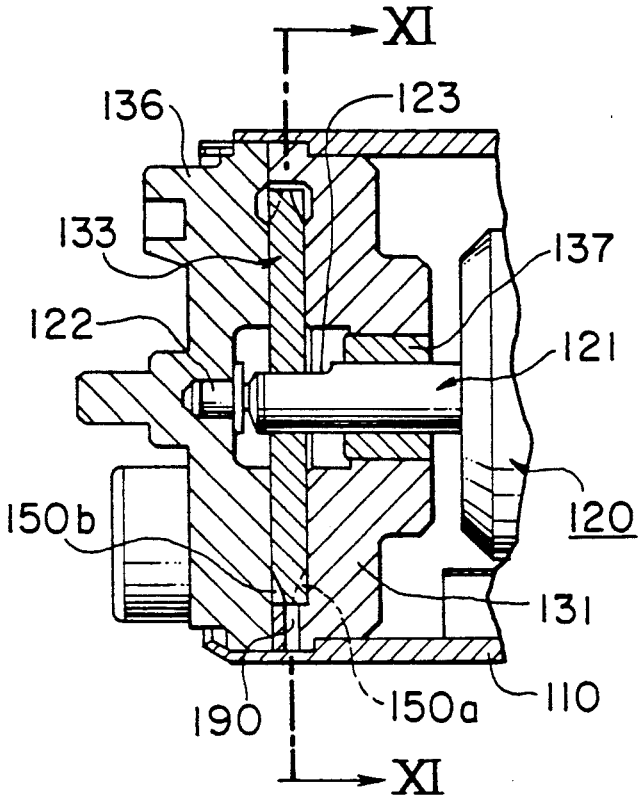
FIG. 10 is a fragmentary sectional view of a vehicle fuel pump according to a fifth embodiment of the present invention.
Figure 11:
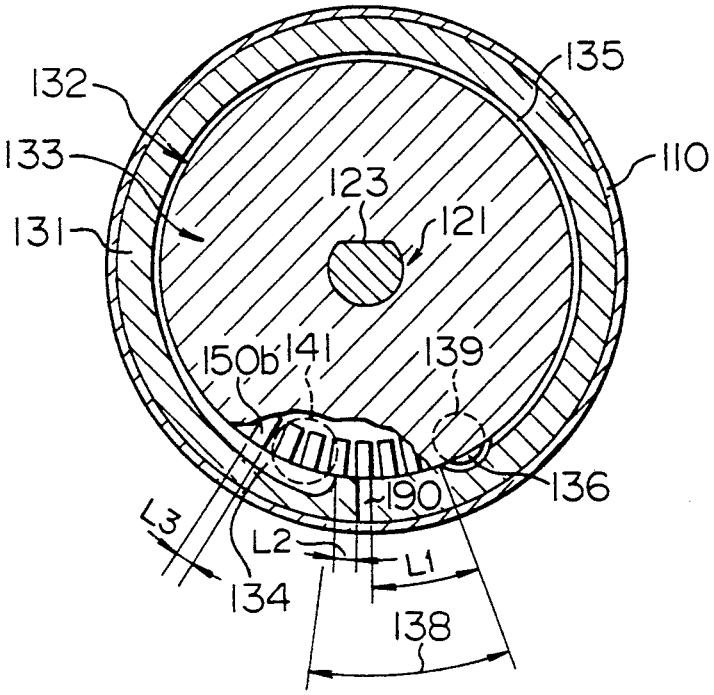
FIG. 11 is a partially sectional view taken along the line XI—XI of FIG. 10.

Referring to FIGS. 10 and 11, a pump casing 131 and a pump cover 136 are received in a housing 110 so as to define therebetween a working chamber. They are assembled together by caulking an end portion of the housing 110. A shaft 121 of an armature of a motor unit 120 extends through the pump casing 131, and is supported by both a bearing 137 fixed to the pump casing 131 and a thrust bearing 122 fixed to the pump cover 136. Further, the shaft 121 is partially formed with a plane portion 123 so as to have a D shaped cross section. A disk-like impeller 133 is received within the working chamber. A plurality of vane grooves 150*a*, 150*b* are formed in an outer peripheral edge portion of each surface of the impeller 133. The vane grooves 150*a* and 150*b* are formed in the opposite surfaces of the impeller in circumferentially half-pitch offset relation to each other. The impeller 133 is formed with a D shaped opening through which the shaft 121 extends and with which D shaped cross section portion of the shaft 121 is brought into engagement. The working chamber comprises a disk-like space for receiving the impeller 133 and a C shaped flow passage space 132 along the outer periphery of the impeller 133 as shown in FIG. 11. The flow passage space 132 includes a suction portion 134, a pressurizing portion 135 and a discharge portion 136. A suction port 141 is opened to the suction portion 134 and extends through the pump cover 136 so as to be communicated with the fuel tank, while a discharge port 139 extends through the pump casing 131 and is opened to an interior of the housing 110. A partition portion 138 is provided between the discharge portion 136 and the suction portion 134 along a predetermined length so as to prevent the pressure from leaking from the discharge portion 136 to the suction portion 134. The partition portion 138 is formed along the external form of the impeller 133. A radial pressure relief passage 190 is formed in the partition portion 138 of the pump casing 131 and the pump casing 131. The vane grooves 150*a*, 150*b* located in the partition portion 138 communicate with the fuel tank through pressure relief passage 190. It is noted here that the diameter of the pressure relief passage 190 is so determined as to allow the both vane grooves 150*a*, 150*b* in the opposite surfaces of the impeller 131 to be communicated therewith. Further, the position of the opening of the pressure relief passage 190 in the partition portion 138 is so set as to make a distance L1 from the end of the discharge portion 136 sufficiently large as well as to make a distance L2 to the suction portion 134 larger than a width L3 of the vane groove. In consequence, pressure leakage from the discharge portion 136 to the pressure relief passage 190 can be reduced and the fuel can be prevented from being sucked from the pressure relief passage 190.

As the shaft 121 of the motor unit 120 rotates, the impeller 133 is rotated clockwise in FIG. 11. Fuel is sucked from the suction port 141 and pressurized in the pressurizing portion 135 with producing eddy flows, by means of the movement of the vane grooves 150. The pressurized fuel is discharged from the discharge port 139 into the housing 110 and is supplied to a fuel injection device for an internal combustion engine which is not shown. The vane grooves 150*a* and 150*b* arrive again at the inlet portion 134 via the discharge portion 136 and the partition portion 138. The vane grooves 150*a* and 150*b* contain the fuel of discharge pressure immediately after it is moved from the discharge portion 136 into the partition portion 138, and however, this fuel of discharge pressure is discharged into the fuel tank through the pressure relief passage 190. In this way, the pressure relief passage 190 functions as auxiliary discharge port so as to discharge the fuel of discharge pressure remaining in the vane groove. In consequence, it is possible to prevent the fuel of discharge pressure from being brought in the suction portion 134 by the vane grooves 150*a* and 150*b*, thereby making it possible to prevent generation of vapor due to vacuum boiling of the fuel of discharge pressure.

Although the pressure relief passage 190 is communicated with the vane grooves 150*a* and 150*b* in the opposite surfaces, even if it is communicated with the vane grooves in one of the surfaces, vapor reducing effect can be obtained. Further, although the pressure relief passage extends radially, it may be possible that the pressure relief passage extends axially so as to communicate with the vane grooves in the both surfaces of the impeller.

Moreover, in the fifth embodiment, the present invention is applied to a closed vane type pump in which the impeller 133 has the independent vane grooves formed in a peripheral edge portion of each surface thereof, and however, the present invention can be applied to a side channel type pump in which the impeller has the vane grooves formed in the both end faces of the impeller and an open vane type pump in which the impeller is provided at the outer periphery thereof with the vane grooves through which the opposite surfaces of the impeller are communicated with each other.

In this embodiment, within the rotation range of 360°, one suction port and one discharge port are provided, between which the pressurizing portion and the partition portion are provided. However, it is also possible to provide a two-stage pump in which first and second suction ports and first and second discharge ports are provided within the rotation range of 360° so as to form a first pressurizing portion extending from the first suction port to the first discharge port and a second pressurizing portion extending from the second suction port to the second discharge port. In this case, the pressure relief passages are provided in a first partition portion formed between the first discharge port and the second suction port and a second partition portion formed between the second discharge port and the first suction port.

As has been described above, according to the present invention, since each pressure chamber passed through the discharge port is brought into being communicated with the outside of the pump before it is communicated with the suction port and hence the pressure therein is reduced, fluid of the discharge pressure is prevented from being brought in the suction port by the pressure chamber, thereby making it possible to prevent the generation of vapor, resulting in the prevention of the disadvantages such as reduction of the discharge rate.

What is claimed is:

1. A pump for pumping fluid comprising:

a casing provided with a suction port through which the fluid is introduced, a discharge port from which the fluid is discharged, and a partition portion disposed between said discharge port and said suction port;

rotary operation means received in said casing, rotated to pressure and discharge the fluid to said discharge port, and providing a plurality of pressure chambers each of which is moved to pass over said partition portion to communicate with said suction port after disconnection from said discharge port;

pressure relief means communicated with each said pressure chamber moving over said partition portion so as to reduce the pressure in each said pressure chamber;

a motor for driving said rotary operation means; and a housing for receiving said motor and said casing, said pressure relief means communicating with a space, pressure in said space being less than a discharge pressure at said discharge port, said pressure relief means comprising a pressure relief passage formed between said casing and said housing, said pump being immersed in fluid contained in a fluid tank, said pressure relief passage communicating with an inside of said fluid tank.

2. A pump according to claim 1, wherein said fluid is fuel.

3. A pump according to claim 1, wherein said rotary operation means comprises an inner rotor provided with external gear teeth and an outer rotor provided with internal gear teeth the number of which is larger by one than that of said external gear teeth, said inner rotor cooperating with said outer rotor to define therebetween a plurality of pressure chambers which are moved with changing their volumes with the rotation of said inner and outer rotors, and wherein said casing serves to form side walls of said pressure chambers.

4. A pump according to claim 3, wherein said pressure relief passage is formed in said side wall of said pressure chambers.

5. A pump according to claim 4, wherein said passage is opened into a portion of said side wall of said pressure chambers corresponding to said partition portion.

6. A pump according to claim 4, wherein said pressure relief passage is defined by a groove formed in a portion of said side wall of said pressure chamber corresponding to said partition portion.

7. A gear pump for pumping fluid sucked from a suction space comprising:

an annular outer rotor formed with internal gear teeth on an inner periphery thereof;

an inner rotor received in said outer rotor and formed with external gear teeth on an outer periphery thereof for meshing engagement with said internal gear teeth, said inner rotor cooperating with said outer rotor to define between said internal gear teeth and said external gear teeth a plurality of pressure chambers;

a casing in which said outer and inner rotors are eccentrically rotatably received and which forms side walls of said pressure chambers;

driving means for rotating said outer and inner rotors and moving said pressure chambers while changing the volumes thereof;

a suction port formed in said casing and communicated with the pressure chambers the volumes of which are being increased;

a discharge port formed in said casing and communicated with the pressure chambers the volumes of which are being decreased; and a pressure relief passage through which the pressure chamber moving from said discharge port to said suction port is communicated with said suction space before being communicated with said suction port so as to reduce the fluid pressure in said pressure chamber.

8. A gear pump according to claim 7, wherein said fluid is fuel and said gear pump is immersed in the fuel contained in a tank.

9. A gear pump according to claim 8, wherein said pressure relief passage extends through said casing.

10. A gear pump according to claim 8, wherein said casing comprises a spacer member by which said outer rotor is received rotatably and a member assembled to said spacer member and serving to form a side wall of said pressure chambers, and wherein said pressure relief passage comprises a groove formed in said side wall member.

11. A gear pump according to claim 8, further comprising a housing for receiving said casing, and wherein said pressure relief passage comprises a hole extending through said housing.

12. A gear pump according to claim 8, further comprising a housing for receiving said casing, and wherein said pressure relief passage comprises a passage formed between said casing and said housing.

* * * * *